United States Patent [19]

Matsuoka

[11] 4,058,414

[45] Nov. 15, 1977

[54] METHOD OF MAKING COLD-ROLLED HIGH STRENGTH STEEL SHEET

[75] Inventor: Takashi Matsuoka, Osaka, Japan

[73] Assignee: Sumitomo Metal Industries, Ltd., Japan

[21] Appl. No.: 645,330

[22] Filed: Dec. 30, 1975

[51] Int. Cl.[2] ..... C21D 7/02; C21D 7/14; C21D 9/46

[52] U.S. Cl. ..... 148/12 F; 75/123 J; 75/123 L; 75/123 M; 75/123 N

[58] Field of Search ..... 148/12 F, 36; 75/123 J, 75/123 L, 123 M, 123 N

[56] References Cited

U.S. PATENT DOCUMENTS

| | | | |
|---|---|---|---|
| 3,830,669 | 8/1974 | Matsuoka et al. | 148/12 F |
| 3,902,927 | 9/1975 | Pernstal | 148/12 F |
| 3,936,324 | 2/1976 | Uchida et al. | 148/12 F |

*Primary Examiner*—W. Stallard
*Attorney, Agent, or Firm*—Jacobs & Jacobs

[57] ABSTRACT

Disclosed are a cold-rolled high strength steel sheet having excellent cold workability under the as-annealed condition which consists essentially of, by weight, 0.03 - 0.2% C, 0.6 - 1.5% Si, 1.3 - 3.0% Mn, 0.01 - 0.25% Nb or 0.01 - 0.2% Ti or 0.01 - 0.3% Nb plus Ti, and the remainder of Fe with inevitable amounts of impurities, and the method of making the same. The steel sheet can be as thin as 3mm or less while possessing a high tensile strength of 50 to 100 kg/mm$^2$, and is extremely suitable for use as a constructional material of car bodies.

2 Claims, No Drawings

METHOD OF MAKING COLD-ROLLED HIGH STRENGTH STEEL SHEET

BACKGROUND OF THE INVENTION

This invention relates to a process for manufacturing a cold-rolled high strength steel sheet having excellent cold workability, and to the coldrolled high strength steel sheet manufactured by said process, and further to a car body comprising said cold-rolled high strength steel sheet. Such cold rolled steel sheet for car body has preferably a thickness of 3.0mm or less.

Recently constant efforts have been made in the fabrication of cars to reduce the weight of car body not only from the view points of meeting sefety requirements and reducing pollution by exhaust gases, but also as a means for reducing the amount of fuel consumed. For accomplishing these aims, cold-rolled high strength steel sheets have come into wide use in place of conventional mild steel sheets.

U.S. Pat. No. 3,830,699, issued to T. Matsuoka et al, discloses a process for manufacturing such steel sheet: The subject matter of the invention of this U.S. Patent resides in making a steel comprising 0.03 – 0.2%C, 1.6 – 3.0% Mn, 0.03 – 0.6% Si, 0.01 – 0.25% Nb and/or 0.01 – 0.2% Ti, and the remainder of Fe and inevitable impurities, hot rolling and cold rolling into a steel sheet of thickness of 3 mm or less, and annealing the steel sheet at a temperature of 620° C to $A_3$ transformation point. In the invention of this U.S. patent, the amount of Si and Mn contained are specified as claimed because silicon contained in excess of 0.6% increases the brittleness and deteriorates the weldability of the steel and manganese contained at less than 1.6% does not impart to the steel a tensile strength of 50 kg/mm$^2$ or more.

SUMMARY OF THE INVENTION

The present inventor has found through further study of the steels of the type as disclosed in said U.S. patent that an increase in silicon content even exceeding 0.6% does not deteriorate the weldability for spot-welding and rather may enhance the cold workability of the steel which may be expressed, for example, in terms of elongation under tension.

Accordingly, it is an object of the present invention to manufacture a cold-rolled steel sheet having improved cold-workability while keeping high tensile strength.

It is another object of the present invention to provide a car body made of such cold-rolled steel sheet.

These and other objects, features end advantages of the present invention will appear more fully from the following description.

DETAILED DESCRIPTION

Since the steel sheet of the present invention is mainly directed toward usage as a constructional material for car bodies, it is not ordinarily used as sheet but in almost all cases is subjected to cold working or forming. Thus not only the strength but the cold workability of the steel sheet are of great importance.

For mild steel plate, Lankford's $\gamma$ value is related to the cold forming properties of the steel, and thus must be increased for improvement thereof.

It is however known that, for a high strength steel plate such as that of the present invention, elongation due to tension is a better criterion for forming properties than the $\gamma$ value. It is therefore advantageous in cold forming a steel having a certain desired strength that it be endowed with higher elongation.

As stated above, the present invention is based on the discovery that increase in silicon content rather enhances elongation due to tension and does not cause serious deterioration in spot-weldability. As is suggested in the above-mentioned U.S. patent, higher silicon content is not preferred from the view point of brittleness, which may be determined by such a method as the charpy test. However, it can be stated that such deterioration in brittleness does not become a serious problem in the practical use of film steel sheet such as that of the present invention.

Therefore according to the present invention there is firstly provided a process for manufacturing a cold-rolled high strength steel sheet having excellent hot workability which comprises: making a steel consisting essentially of, by weight, 0.03 – 0.2% C, 0.6 – 1.5% Si, 1.3 – 3.0% Mn, 0.01 – 0.25% Nb or 0.01 – 0.2% Ti or 0.01 – 0.3% Nb plus Ti, and the remainder of Fe with inevitable amounts of impurities, hot rolling and cold rolling the steel into a steel sheet, and then annealing the steel sheet at a temperature of 620° C to $A_3$ transformation point.

Secondly, the present invention relates to a cold rolled steel sheet manufactured by said method.

The steel sheet of the present invention can be as thin as 3 mm or less while possessing a high tensile strength of 50 to 100 kg/mm$^2$.

The steel sheet of the present invention is thus extremely suitable for use as a constructional material of car bodies and results in remarkably reducing the weight of the car body for which it is used while maintaining high strength.

Accordingly, the invention further relates to a car body made of the cold-rolled steel sheet manufactured by said process.

The reasons for specifying the steel composition of the present invention are given below.

A carbon content of less than 0.03% does not provide a tensile strength of 50 kg/mm$^2$, while the content must be limited to not more than 0.20% in order to obtain good weldability. A Nb content of less than 0.01% is not effective to improve the strength, while a content exceeding 0.25% fails to improve strength any further. The Ti content should be limited from 0.01 to 0.20% for the same reason as that mentioned for Nb. Further, a Ti content exceeding 0.20% renders ingot-making difficult. The upper limit of Nb plus Ti in combination is specified to be 0.3% since a content exceeding this value does not produce any particular effects.

A manganese content of less than 1.3% does not impart to the steel a tensile strength of 50 kg/mm$^2$ or more, whereas a manganese content exceeding 3.0% makes the process of steel making difficult. As mentioned previously, a silicon content of 0.6% or more rather enhances the elongation property under tension and at the same time the tensile strength to some degree. On the other hand, the upper limit of the silicon content should be 1.5%.

With a silicon content of 0.6 to 1.5% and a manganese content of 1.3 to 3.0%, the steel sheet of the present invention exhibits excellent cold workability as indicated by higher elongation, while it keeps its high tensile strength. It can be added that the results of tests conducted on the steel sheet of the present invention show that within the defined ranges of Si and Mn, higher silicon content (1.0 – 1.5%, particularly 1.2 – 1.5) and lower manganese content (1.3 – 2.0%) enhance elongation to a further extent. Such increase in the silicon content will slightly lower the weldability of the steel sheet. However, this is not a serious problem, insofar as the spot-welding, which is commonly employed in the manufacture of car bodies, is concerned.

Constructional materials for use in car bodies should be excellent in deep drawing property and ductility, which properties may be expressed in terms of elongation under tension, while strength is maintained as high as possible. The steel sheet of the present is thus suitable for use as a constructional material for car bodies.

The steel of the present invention is subjected to hot-rolling and cold-rolling into sheet as in the case of the manufacture of an ordinary cold-rolled steel. The steel sheet should be annealed thereafter at a temperature of 620° C to $A_3$ transformation point. Annealing below 620° C does not cause satisfactory recrystallization and results in poor recovery of ductility of the product. On the other hand, annealing at a temperature over $A_3$ transformation point should be avoided since such procedure will result in undesirable sintering and deformation of product steel sheet and, further, is uneconomical.

The present invention will be understood more clearly with reference to the following examples showing some results of tests on the physical properties of the steel sheet of the present invention. It should be noted however that these examples are intended to illustrate the invention and are not to be construed to limit the scope thereof.

EXAMPLE 1

Steel ingots prepared with a high frequency furnace and having the compositions indicated in Table 1 were separately hot-rolled at a finishing temperature of 850° C into strips of a thickness of 2.5 mm. Each of the steel strips was pickled and then cold-rolled into a steel sheet of a thickness of 0.8 mm. The sheets were annealed at a predetermined temperature and samples of each was subject to the tests according to the methods specified by the Japanese Industrial Standards. The results are summarized in Table 2.

Table 1

| Sample No. | Composition, % by weight C | Si | Mn | P | S | Nb | Ti |
|---|---|---|---|---|---|---|---|
| Steels for comperison | | | | | | | |
| C3 | 0.07 | 0.31 | 2.08 | 0.003 | 0.005 | 0.06 | — |
| C4 | " | 0.33 | 2.27 | 0.004 | 0.006 | 0.06 | — |
| C5 | " | 0.38 | 2.47 | 0.004 | 0.006 | 0.05 | — |
| C6 | " | 0.34 | 2.71 | 0.004 | 0.006 | 0.06 | — |
| C8 | " | 0.55 | 1.86 | 0.004 | 0.006 | 0.05 | — |
| Steels of this invention | | | | | | | |
| C14 | 0.09 | 0.70 | 1.88 | 0.006 | 0.007 | 0.05 | — |
| C15 | 0.07 | 0.97 | 2.09 | 0.006 | 0.008 | 0.05 | — |
| C16 | " | 0.94 | 2.24 | 0.006 | 0.007 | 0.05 | — |
| C17 | " | 0.93 | 2.41 | 0.006 | 0.006 | 0.06 | — |
| C18 | " | 0.92 | 2.61 | 0.006 | 0.006 | 0.05 | — |
| C19 | 0.11 | 1.31 | 1.80 | 0.006 | 0.006 | 0.05 | — |
| C20 | 0.11 | 1.20 | 2.63 | 0.007 | 0.006 | — | 0.10 |
| C21 | 0.09 | 1.35 | 2.71 | 0.006 | 0.006 | 0.05 | 0.08 |

Table 2

| Sample No. | Anneal. Temp. ° C | T.S. kg/mm² | Elong % |
|---|---|---|---|
| Steels for comparison | | | |
| C3 | 690 | 53.2 | 29.0 |
| | 720 | 53.6 | 29.0 |
| | 750 | 51.9 | 30.0 |
| C4 | 690 | 53.5 | 28.5 |
| | 720 | 55.0 | 28.0 |
| | 750 | 54.1 | 29.0 |
| C5 | 690 | 57.2 | 28.0 |
| | 720 | 60.1 | 26.5 |
| | 750 | 59.7 | 26.5 |
| C6 | 690 | 62.0 | 25.5 |
| | 720 | 64.4 | 25.0 |
| | 750 | 66.0 | 23.5 |
| C8 | 690 | 51.6 | 28.5 |
| | 720 | 51.3 | 30.0 |
| | 750 | 49.5 | 30.0 |
| Steels of this invention | | | |
| C14 | 720 | 53.1 | 32.3 |
| | 690 | 56.7 | 31.0 |
| C15 | 720 | 56.8 | 30.0 |
| | 750 | 55.7 | 30.5 |
| C16 | 690 | 58.8 | 29.0 |
| | 720 | 58.9 | 28.9 |
| | 750 | 58.1 | 29.5 |
| C17 | 790 | 61.4 | 28.0 |
| | 720 | 61.5 | 28.0 |
| | 750 | 61.1 | 28.0 |
| C18 | 690 | 64.0 | 28.0 |
| | 720 | 64.5 | 26.5 |
| | 750 | 64.3 | 27.0 |
| C19 | 690 | 61.6 | 28.3 |
| | 720 | 61.8 | 28.0 |
| | 750 | 61.5 | 28.2 |
| C20 | 750 | 68.7 | 24.1 |
| C21 | 750 | 71.2 | 22.9 |

EXAMPLE 2

This example is to show that higher silicon content will increase elongation (%). The samples tested were all prepared in the same manner as in Example 1. The results are summarized in Table 3.

Table 3

| Sample No. | Composition, % by weight C | Si | Mn | P | S | Nb | Anneal. Temp ° C | T.S.$_2$ kg/mm² | Elong. % |
|---|---|---|---|---|---|---|---|---|---|
| E 1 | 0.07 | 0.94 | 1.63 | 0.009 | 0.009 | 0.05 | 680 | 55.3 | 29.0 |
| E 2 | 0.03 | 1.26 | 1.67 | 0.010 | 0.009 | 0.07 | | 55.1 | 29.8 |
| E 3 | 0.08 | 0.65 | 2.79 | 0.007 | 0.008 | 0.11 | 690 | 61.6 | 26.8 |
| E 4 | 0.10 | 1.41 | 1.71 | 0.006 | 0.008 | 0.11 | | 61.7 | 28.3 |
| E 5 | 0.07 | 2.65 | 2.63 | 0.012 | 0.013 | 0.10 | 670 | 64.5 | 26.1 |
| E 6 | 0.12 | 1.47 | 1.06 | 0.009 | 0.009 | 0.11 | | 64.8 | 27.2 |

On comparing $E_4$ with $E_2$, $E_3$ with $E_4$, and $E_5$ with $E_6$ respectively, it can be seen that the steels with higher silicon content exhibit higher elongation at almost the same tensile strength.

I claim:

1. In the process of manufacturing a cold-rolled, high strength steel sheet in which a steel containing, in addition to iron and silicon, 0.03 to 0.2% by weight of carbon, 1.3 to 3.0% by weight of manganese and either (a) 0.01 to 0.25% by weight of niobium, or 0.01 to 0.2% by weight of titanium or (b) 0.01 to 0.3% by weight of niobium and titanium is hot rolled and cold rolled into a steel sheet which sheet is then annealed at a temperature of from 620° C to the $A_3$ transformation point, the improvement which consists of utilizing from 1.0 to 1.5% by weight of silicon.

2. The process according to claim 1 wherein the manganese content of the steel is from 1.3 to 2.0% by weight.

* * * * *